United States Patent [19]

Simeth

[11] 4,341,157

[45] Jul. 27, 1982

[54] VIBRATION-ABSORBING CYLINDER FOR PRINTING PRESSES

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 248,311

[22] Filed: Mar. 27, 1981

[30] Foreign Application Priority Data

Mar. 28, 1980 [DE] Fed. Rep. of Germany ..... 3012060

[51] Int. Cl.[3] ..... B41F 13/08

[52] U.S. Cl. ..... 101/375; 101/217; 101/142; 101/415.1; 100/162 B; 29/124

[58] Field of Search ..... 101/216, 217, 218, 219, 101/375, 376, 378, 415.1, 130, 132, 136, 141, 142, 143, 144, 145; 29/110, 121.1, 121.5, 124, 129, 132; 100/155 R, 176, 162 B

[56] References Cited

U.S. PATENT DOCUMENTS 3,453,955 10/1965 Seel et al. ..... 101/216

FOREIGN PATENT DOCUMENTS 2549461 1/1977 Fed. Rep. of Germany ..... 101/378

*Primary Examiner*—Paul T. Sewell
*Assistant Examiner*—Daniel J. Roock
*Attorney, Agent, or Firm*—Leydig, Voit, Osann, Mayer & Holt, Ltd.

[57] ABSTRACT

A vibration-free cylinder for a printing press in phased rolling engagement with a companion cylinder and which is formed of a cylinder body of star-shaped cross section having a central axial portion and four axial webs extending radially outward therefrom to define between them recesses of sector-shaped cross section. The surface of the cylinder is formed by first and second arcuate shell segments, the first of which extends over substantially half of a revolution and the second over substantially one-quarter revolution, the segments having parallel edges bridging the tip portions of the webs for enclosing all but one of the recesses which is uncovered to produce a gap defining the leading edge of the cylinder surface. The web at the leading edge is extended outwardly to the locus of the cylinder surface so that the cylinder body absorbs the impact with the companion cylinder which occurs at the leading edge at each revolution. The edges of the shell segments are in abutting relation to the tip portions of the webs, with a resilient vibration-dampening layer of adhesive being interposed at the abutting surfaces. The webs are so designed and positioned that maximum resistance to bending stress is in the plane of the web at the leading edge position. In the preferred embodiment the enclosed recesses are in addition occupied by vibration-absorbing material.

10 Claims, 4 Drawing Figures

PRESS DRIVE
LEADING EDGE
TRAILING EDGE
GAP
PL

VIBRATION-ABSORBING CYLINDER FOR PRINTING PRESSES

The cylinders of a letter press or a lithograph press, particularly the latter, conventionally have peripheral gaps extending longitudinally thereon and phased to come into opposition as the cylinders rotate. When the leading edges of the cylinders, defined by the gaps, engage one another during each cylinder revolution a violent impact occurs which tends to cause it to vibrate or "ring". The vibration, persisting after the impact has occurred, results in stripes in the printed image thereby degrading the quality of the printing. A similar vibratory phenomenon occurs upon the abrupt release of pressure at the trailing edge. It has long been the concern of the industry to control such vibration. For example, in German Auslegeschrift DE-OS 2 529 461 it is proposed to provide a cylinder in which the surface is formed of individual segments. The arrangement has the disadvantage that the segments must absorb the impact at the leading edge with the result that the cylinder must be regarded as a single unit and harmful vibration therefore still occurs. In addition, the arrangement lacks the strength and security required as the cylinder is rotated at high speed.

It is a general object to provide a cylinder for a printing press in which the impact at the leading edge of the surface, defined by the gap, does not result in stripes in the printed image, making possible the highest quality of printing at even the highest printing rates.

It is a more specific object to produce a vibration-free cylinder formed of a unitary cylinder body having radial webs thereon with a plurality of arcuate shell segments forming a surface having a gap, with the web in at least the leading edge position being extended outwardly to the locus of the cylinder surface to absorb impact while leaving the shell segments substantially unaffected by vibration or ringing.

It is another object to provide a cylinder for a printing press in which the outer working surface is resiliently isolated from the effect of impact at the leading edge and in which the cylinder body is so constructed that the maximum resistance of the body to bending stress is in the plane of the leading edge position thereby permitting the body to absorb, within itself, a maximum degree of impact. It is a related object to provide a cylinder in which the webs of the body and the edges of the arcuate shell segments are in abutting relation and in which a resilient vibration-dampening layer of adhesive is interposed at the abutting surfaces not only to provide isolation for the shell segments but to dampen the vibration of the cylinder, resulting from impact, as promptly and as effectively as possible.

It is a general object of the invention to provide a cylinder for a printing press which is substantially vibration-free upon being subject to cyclical impact but which is of light inexpensive construction and which, at the same time, is inherently strong and secure even when operated at the highest rotative speeds achieved in modern presses.

Other objects and advantages of the invention will become apparent upon reading the attached detailed description and upon reference to the drawing in which:

FIG. 1 is a transaxial view, in elevation, taken through a set of three cooperating cylinders in a lithographic printing press, each of the cylinders being constructed in accordance with the present invention.

FIG. 1*a* is a fragment showing a typical joint including resilient vibration-dampening adhesive between abutting surfaces.

Figures 1, 1A, 2, 3:
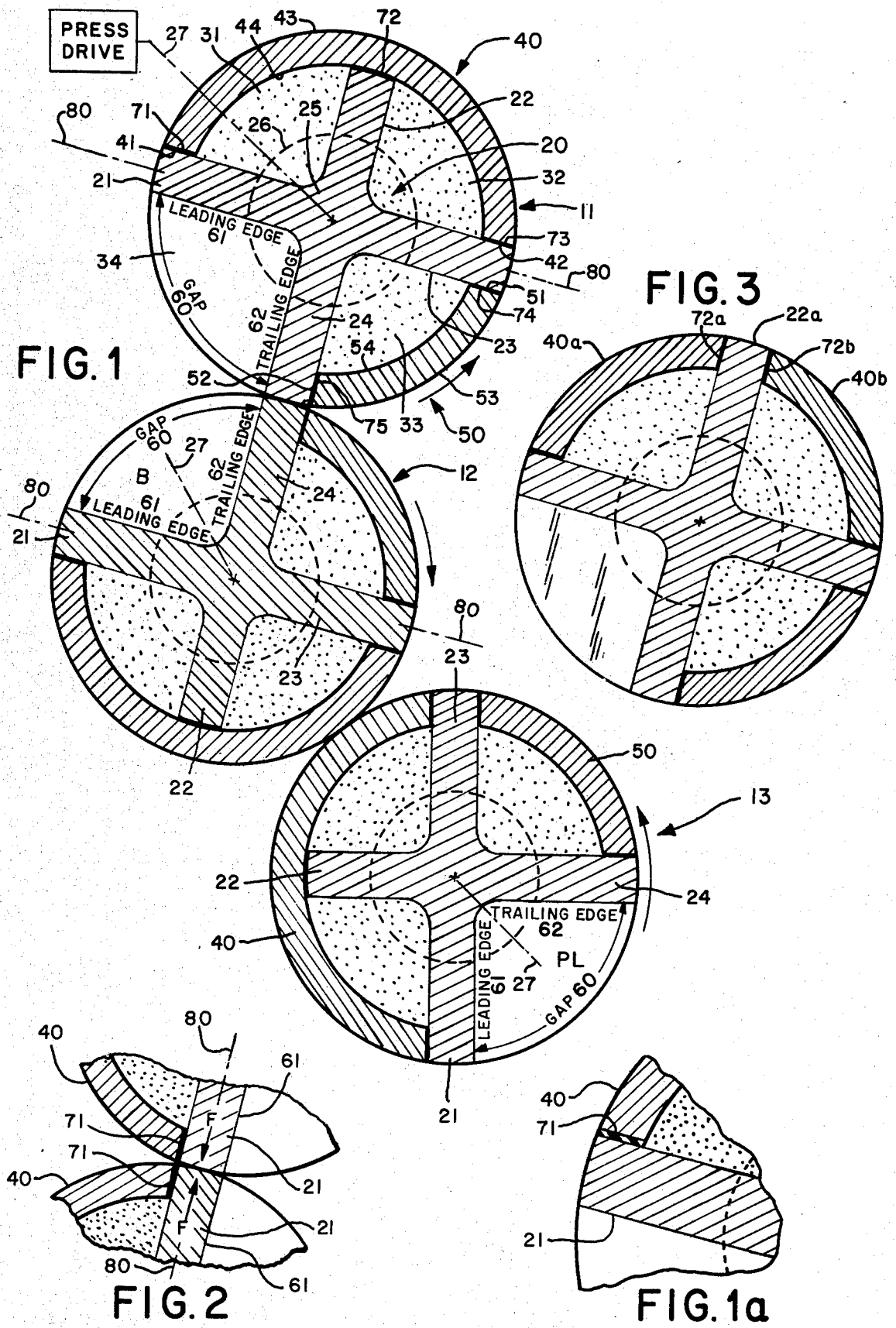
FIG. 2 is a fragment showing the first two cylinders phased for impact and the forces resulting therefrom.
FIG. 3 is a transaxial view of a slightly modified cylinder having a total of three arcuate shell segments.

While the invention has been described in connection with certain preferred embodiments, it will be understood that I do not intend to be limited to the particular embodiments shown but I intend, on the contrary, to cover the various alternative and equivalent constructions included within the spirit and scope of the appended claims.

Turning now to the drawing there is shown in FIG. 1 a set of three cooperating cylinders of similar construction and in rotating engagement with another and indicated at 11, 12 and 13, respectively. The cylinder 11 may be understood to be an impression cylinder, cylinder 12 a blanket cylinder and cylinder 13 a plate cylinder as used in a lithograph press. For the sake of simplicity the usual covering has been omitted on the impression cylinder, the blanket has been omitted on the blanket cylinder and the plate on the plate cylinder along with the tensioning and lock-up devices normally provided therefor, reference being made to the voluminous patented art and to the literature for a showing of such elements.

For an understanding of the details of a typical one of these cylinders, attention may be concentrated upon the impression cylinder 11. Such cylinder has a unitary body indicated at 20 of star-shaped cross section having radially extending arms, or webs, 21, 22, 23 and 24 which extend the length of the cylinder and which are preferably integral with a central axial portion 25. The latter terminates in stub shafts indicated at 26 by the dot-dash outline. The stub shafts are journaled in appropriate bearings (not shown) in the press frame plates, with a driving connection 27, as is customary. The axial webs 21–24 define between them recesses 31–34 which are of sector-shaped cross section and which extend longitudinally of the cylinder.

Mounted upon the cylinder body and, together, forming the cylinder surface, are arcuate shell segments. The first, indicated at 40, has parallel edges 41, 42, an outer cylindrical surface 43 and an inner cylindrical surface 44. The second shell segment 50 has parallel edges 51, 52, an outer cylindrical surface 53 and an inner cylindrical surface 54. The shell segments extend bridgingly between the tip portions of the associated webs for enclosing the sector-shaped recesses 31, 32 and 33, that is, all but one of the recesses, leaving the recess 34 uncovered to produce a gap 60 in the cylinder surface, the gap defining a leading edge 61 and trailing edge 62 as the cylinder rotates.

The cylinders are phased by the press drive 27 so that the gaps 60 of the adjacent cylinders are opposed to one another, that is to say, the leading edges and trailing edges of adjacent cylinders respectively strike one another in synchronism. Since the cylinders are in pressing engagement with one another due to the "throw" adjustment (not shown) of their respective bearings, there is an impact at the leading edges 61 of the cylinders when they come together during the course of each revolution. This impact, which is illustrated in FIG. 2, produces a high level of radial impact force F in each of the cooperating cylinders.

In accordance with the present invention the shell segments are not made integral with the cylinder body but are secured thereto, and isolated therefrom, by a resilient vibration-dampening layer of adhesive interposed at the abutting surface. Moreover, the web of the cylinder body which is at the leading edge position is extended outwardly to the locus of the cylinder surface so that the cylinder body 20 absorbs the impact with the companion cylinder which occurs at the leading edge at each revolution. The layers of adhesive are respectively indicated at 71–75, with the layer 71, somewhat enlarged, being illustrated in FIG. 1*a*. The extension of the webs 21 to the cylinder locus for direct impact with one another, with the leading edges 61 in alignment, is illustrated in FIG. 2.

As a result of such construction the bodies 20 of the cylinders, and particularly the webs 21 thereon which are in alignment with one another, absorb the impact by bending slightly, while the arcuate shell segments 40, 50, which are largely isolated by the resilient adhesive layers 71–75 remain relatively unaffected. Thus an important feature of the invention resides in the fact that the shell segments which form the outer "working" surface of the cylinders, do not impact with one another directly as the leading edges are traversed.

Further in accordance with the invention the webs are so arranged and of such thickness, and length, that a maximum resistance of the body to bending stress is in the plane of the web at the leading edge position. Turning attention to the first cylinder 11, the plane of the web 21 in leading edge position is indicated at 80, the planes 80 of associated cylinders coming into alignment upon impact as illustrated in FIG. 2. In the present construction the total radial length of the opposed webs 21, 23 is greater than that of the opposed webs 22, 24, the webs being of the same thickness, from which it follows that a maximum resistance of the body to bending stress lies in the plane 80. In other words the cylinder body has a high degree of strength in the radial plane of the impact applied at the leading edges, which serves, of itself, to reduce the amplitude of the resulting vibration. It should be noted, however, that it is not essential in the practice of the invention that the body have greatest resistance to bending in the plane 80. All that is required is that the resistance to bending in such plane shall exceed or closely approach the resistance to bending in a plane at an angle thereto, for example, a plane in 90 degree relation; that is the intended meaning of "a maximum" as used herein.

As a result of the structure described above, it is found that the star-shaped body directly absorbs the impact while deflecting a minimum amount by reason of superior strength in the plane of the impact, with the shell segments which form the working surface being relatively isolated by the adhesive so that the production of stripes in the printed product is either minimized or eliminated entirely, even up to the highest rotative speeds encountered in modern presses. The adhesive layers not only perform an isolating function but also serve to damp any vibration set up in the body of the cylinder. Thus it will be noted that the adhesive layers 71–75 are not all oriented in one plane. This causes vibration of the body in any plane to be promptly damped thereby preventing sustained "ringing" following impact.

The invention has been discussed above in connection with impact at the leading edges of the cylindrical surfaces. It is a feature of the present invention that the web at the trailing edge position is also extended outwardly to the locus of the cylinder surface so that the cylinder body resists responding to the abrupt release of pressure from the companion cylinder which occurs at the trailing edge of each revolution. It will be appreciated by one skilled in the art that, when the webs 24 in FIG. 1 become disengaged from one another upon small incremental movement, the mutual pressure between the cylinders is suddenly released. By extending the webs 24 outwardly to the locus of the outer surface a sudden change in pressure affects only the cylinder body, inducing vibration therein, while leaving the shell segments relatively unaffected. Since the cylinder also has substantial strength in the plane of the web 24 at the trailing edge, that is, at right angles to plane 80 of the leading edge, the cylinder body resists responding to the abrupt release of pressure and the amplitude of the vibration is therefore minimized. Such vibration as does occur tends, also, to be damped by the resilient layers 71–75.

To summarize, then, the construction of the cylinder thus not only tends to minimize the setting up of vibration in the plane of the leading and trailing edges, as the edges are respectively impacted and released, leaving the shell segments relatively unaffected, but any vibration which may be set up in the body is quickly damped by reason of the layers of resilient adhesive.

In accordance with one of the aspects of the present invention the enclosed recesses 31–33, which are of quadrant shape in the present embodiment, are occupied by a vibration absorbing material. Such vibration absorbing material is per se known in the art and may be any material which, upon being subjected to vibration, dissipates the energy of vibration in the form of heat, including particulate materials, "loaded" foam materials, and the like. A material should preferably be chosen having peak absorption at a frequency approximating the natural frequency of vibration of the cylinder. The recesses are preferably completely filled with such material in bonded relation to all of the presented surfaces of the recess including the underside of the shell segments.

It is one of the features of the present construction that unlike a conventional cylinder which is constructed monolithically of steel, the present cylinder may be of composite construction employing one metal, or alloy, for the body and another metal, or alloy, for the shell segments. Thus the body may be made of high strength steel while the shell segments are made of structural aluminum. The result is to produce a largely hollow, light and economical construction which is nonetheless strong particularly in the impact and release planes where the resistance to bending is desired.

While it is preferred to utilize two shell segments extending the length of the cylinder, namely, a first segment 40 extending over substantially half of the revolution and a second segment 50 extending over substantially one-quarter revolution, the invention is not necessarily limited to this and three segments, each spanning a quarter of a revolution, may be used. This is illustrated in FIG. 3 where it will be noted that the first shell segment 40 has been divided into two smaller segments 40*a*, 40*b* with the web which is centered between them being extended radially outward to the locus of the outer surface as indicated at 22*a*. Separate layers of adhesive 72*a*, 72*b* are then used.

It is preferred to use an adhesive which is resilient, yet tough and highly adherent. Thus the adhesive may be in the form of rubber or rubber-like material bonded to the abutting surfaces by vulcanization. This provides a joint which not only has an isolating and damping effect but which is inherently strong and secure even when operated at high rotative speeds. It will be apparent that the characteristics of resiliency and bonding strength may, in a practical case, involve a trade-off, and where maximum bonding strength is required a certain amount of resiliency may be sacrificed without departing from the invention. It will also be apparent that the relative dimensions indicated in the drawing are for purposes of example only and the thicknesses of the shell segments, and the webs, may be varied over wide limits depending upon the strength required for the particular application.

Also, while it is preferred for the sake of simplicity and easy manufacture to employ four webs arranged in opposition at 90 degrees to one another, the invention in its broadest aspect is not limited to any particular number of webs or any particular angular relationship between them provided that the body has a high resistance to bending stress in the plane of the web which is in leading edge position.

What I claim is:

1. A vibration-absorbing cylinder for a printing press intended for phased rolling engagement with a companion cylinder comprising, in combination, a unitary cylinder body of star-shaped cross section extending the length of the cylinder, the body having a central axial portion and a plurality of angularly spaced axial webs extending radially outward therefrom to define between them recesses of sector-shaped cross section longitudinally of the cylinder, a plurality of arcuate shell segments which together form the cylinder surface, the shell segments having parallel edges and extending bridgingly between the tip portions of the associated webs for enclosing all but one of the recesses, the one recess being uncovered to produce a gap in the cylinder surface, the gap defining a leading edge as the cylinder rotates, the web at the leading edge position being extended outwardly to the locus of the cylinder surface so that the cylinder body absorbs the impact with the companion cylinder which occurs at the leading edge at each revolution by reason of the gap, the edges of the segments being in abutting relation to the tip portions of the webs, a resilient vibration-dampening layer of adhesive interposed at the abutting surfaces, the webs being so arranged and of such thickness that maximum resistance of the body to bending stress is in the plane of the web at the leading edge position.

2. A vibration-absorbing cylinder for a printing press intended for phased rolling engagement with a companion cylinder comprising, in combination, a unitary cylinder body of star-shaped cross section extending the length of the cylinder, the body having a central axial portion and a plurality of angularly spaced axial webs extending radially outwardly therefrom to define between them recesses of sector-shaped cross section longitudinally of the cylinder, a plurality of arcuate shell segments which together form the cylinder surface, the shell segments having parallel edges and extending bridgingly between the tip portions of the associated webs for enclosing all but one of the recesses, the one recess being uncovered to produce a gap in the cylinder surface, the gap defining a leading edge as the cylinder rotates, the web at the leading edge being extended outwardly to the locus of the cylinder surface so that the cylinder body absorbs the impact with the companion cylinder which occurs at the leading edge at each revolution by reason of the gap, an opposite web being positioned 180 degrees from the web at the leading edge and extended outwardly to the locus of the cylinder surface so that maximum resistance to bending stress lies in the plane of the leading edge web and the opposite web, the edges of the segments being in abutting relation to the tip portions of the webs, a resilient vibration-dampening layer of adhesive being interposed at the abutting surfaces.

3. A vibration-absorbing cylinder for a printing press intended for phased rolling engagement with a companion cylinder comprising, in combination, a unitary cylinder body of star-shaped cross section extending the length of the cylinder, the body having a central axial portion and four angularly spaced axial webs extending radially outward therefrom to define between them recesses of sector-shaped cross section longitudinally of the cylinder, a plurality of arcuate shell segments which together form the cylinder surface, the shell segments having parallel edges and extending bridgingly between the tip portions of the associated webs for enclosing all but one of the recesses, the one recess being uncovered to produce a gap in the cylinder surface, the gap defining a leading edge as the cylinder rotates, the web at the leading edge position being extended outwardly to the locus of the cylinder surface so that the cylinder body absorbs the impact with the companion cylinder which occurs at the leading edge at each revolution by reason of the gap, the edges of the segments being in abutting relation to the tip portions of the webs, a resilient vibration-dampening layer of adhesive interposed at the abutting surfaces, the web at the leading edge having another web in diametrical opposition so that maximum resistance of the body to bending stress is in the plane of the web at the leading edge position.

4. A vibration-absorbing cylinder for a printing press intended for phased rolling engagement with a companion cylinder comprising, in combination, a unitary cylinder body of star-shaped cross section extending the length of the cylinder, the body having a central axial portion and four axial webs angularly spaced at 90 degree intervals extending radially outwardly therefrom to define between them recesses of quadrant cross section longitudinally of the cylinder, first and second arcuate shell segments which together form the cylinder surface, the first segment extending over substantially half of a revolution and the second segment extending over substantially one-quarter revolution, the segments having parallel edges and extending bridgingly between the tip portions of the webs for enclosing all but one of the recesses, the one recess being uncovered to produce a gap in the cylinder surface, the gap defining a leading edge as the cylinder rotates, the web at the leading edge being extended outwardly to the locus of the cylinder surface so that the cylinder body absorbs the impact with the companion cylinder which occurs at the leading edge at each revolution by reason of the gap, the edges of the segments being in abutting relation to the tip portions of the webs, and a resilient vibration-dampening layer of adhesive interposed at the abutting surfaces, the webs being of such thickness and radial length that maximum resistance of the body to bending stress is in the plane of the web at the leading edge position.

5. The combination as claimed in claim 1 or in claim 2 or in claim 3 or in claim 4 in which the gap defines a trailing edge in addition to the leading edge and in which the web at the trailing edge position is extended outwardly to the locus of the cylinder surface so that the cylinder body resists responding to the abrupt release of pressure from the companion cylinder which occurs at the trailing edge at each revolution by reason of the gap.

6. The combination as claimed in claim 1 or in claim 2 or in claim 3 or in claim 4 in which the enclosed recesses are occupied by vibration-absorbing material.

7. The combination as claimed in claim 1 or in claim 2 or in claim 3 or in claim 4 in which the enclosed recesses are filled with foam vibration-absorbing material.

8. The combination as claimed in claim 1 or in claim 2 or in claim 3 or in claim 4 in which the cylinder body is made of steel and the shell segments are made of aluminum.

9. The combination as claimed in claim 1 or in claim 2 or in claim 3 or in claim 4 in which the companion cylinder is of the same construction in mirror image with the leading edges of the two cylinders being in rolling phase with one another.

10. The combination as claimed in claim 1 or in claim 2 or in claim 3 in which the shell segments are three in number, each segment extending over substantially one-quarter revolution.

* * * * *